United States Patent [19]

Green

[11] 4,241,388

[45] Dec. 23, 1980

[54] HIGH CONTRAST LAMP ASSEMBLY

[75] Inventor: Stanley Green, Smethwick, England

[73] Assignee: Lucas Industries Limited, Birmingham, England

[21] Appl. No.: 39,548

[22] Filed: May 16, 1979

[30] Foreign Application Priority Data

May 30, 1978 [GB] United Kingdom ..... 24567/78

[51] Int. Cl.[3] ..... F21V 9/00

[52] U.S. Cl. ..... 362/268; 362/293; 362/311; 362/360

[58] Field of Search ..... 362/268, 293, 311, 360

[56] References Cited

U.S. PATENT DOCUMENTS 3,851,165 11/1974 Beck et al. ..... 362/268

*Primary Examiner*—Stephen J. Lechert, Jr.
*Attorney, Agent, or Firm*—Ladas & Parry

[57] ABSTRACT

A lamp assembly, particularly intended for use on a motor vehicle, comprises a reflector which receives a light bulb, and a first lens element which overlies the reflector and which has formed on one surface thereof a multiplicity of individual lenses. A baffle is secured to the opposite surface of the first lens element, and includes a multiplicity of light-transmitting portions each of which is disposed on the optical axis of a respective one of the individual lenses and whose extent is limited to that necessary to transmit substantially the whole of a pencil of light rays which is focussed by the respective individual lens. The remainder of the baffle is light-obstructing. A second lens element overlies the first lens element and the baffle, and also includes a multiplicity of individual lenses which are in no particular registration with the individual lenses of the first lens element. The first lens element can be shaped suitably for the securement thereto of the baffle, which is advantageously made from planar material, whereas the second lens element can be shaped according to the desired external configuration of the lamps assembly.

22 Claims, 6 Drawing Figures

HIGH CONTRAST LAMP ASSEMBLY

This invention relates to a lamp assembly particularly, though not exclusively, for use in a motor vehicle.

It is a common disadvantage of many lamp assemblies that externally incident light entering the lamp assembly and being reflected therein can sometimes be mistaken for light emitted by a light bulb of the assembly. Thus, in bright sunlight for example, the lamp assembly can have the appearance of being energised when in fact it is not.

Several proposals have been made to overcome this problem. One of these proposals involves the use of a light-absorbing filter to attenuate the intensity of externally incident light reflected in the above-described manner compared with the intensity of the light emitted by the lamp assembly when it is energised. However, since the intensity of the light emitted by the lamp assembly is itself attenuated by the light absorbing filter to a certain extent, it is often necessary to use a brighter light bulb or to improve the reflection properties of the reflector to avoid an undesirable decrease in this intensity. This solution is often impractical because of the regulations governing the types of bulb which can be used and the extra cost involved in improving the reflection characteristics of the reflector.

An alternative proposal involves the use of a baffle which is disposed in a particular relation to a lens element of the lamp assembly. The baffle includes a plurality of light-transmitting portions each of which is disposed on the optical axis of a respective individual lens of the lens element and which is confined in its extent to that necessary to transmit substantially the whole of a pencil of light rays which is focussed by the respective lens. The remainder of the baffle is light-absorbing or opaque. In this way, the proportion of the light emitted by the light bulb of the lamp assembly is substantially a maximum, while the proportion of externally incident light which passes through the baffle, is reflected internally of the lamp assembly and passes back through the baffle is substantially a minimum. Examples of lamp assemblies which utilize this proposal are shown in U.S. Pat. No. 3,487,206 and German Pat. No. 2,062,472.

In lamp assemblies of this type, it is the common practice to provide the individual lenses on a surface of the lens element which faces the interior of the lamp assembly, and to secure the baffle to the other surface of the lens element. In other words, the baffle is usually provided on the external surface of the lamp assembly. This not only exposes the baffle to damage, but also gives rise to difficulties where the lamp assembly has to be styled in a particular manner, as will now be explained.

According to current vehicle styling trends, it is often desirable to make the external surface of a lamp assembly (ie. the lens element thereof) conform to the shape of the vehicle body in the region where it is mounted, in order to give the vehicle as a whole a pleasing appearance. If the external surface of the lens element is developable from a flat plane, then it is a comparatively simple matter to manufacture the baffle from sheet or plate material and to secure it to the lens element without distortion. However, if the external surface of the lens element is non-developable from a flat plane (ie. curved in two different directions), then a baffle made from sheet or plate material cannot be secured thereto without distortion and consequential misalignment of the baffle with the lenses: in this case a different (and usually more expensive) manner of manufacturing the baffle must be adopted.

The present invention seeks to overcome this difficulty by providing a cover which forms an external surface of the lamp assembly on the opposite side of the baffle to the lens element. The lens element can now be made of a suitable shape for the application thereto of a baffle made from sheet or plate material, while the cover can be shaped so as to conform to the shape of the vehicle body. The manner of manufacture of the baffle is thus no longer dictated by the external shape of the lamp assembly, in particular where the latter has a curvature in two different directions.

The provision of the cover also has the following advantages:

(1) The cover overlies the baffle and therefore protects it from becoming damaged, and also protects the light-transmitting portions thereof from becoming obscured by dirt.

(2) The cover can be provided with lensing to enhance or modify the spread of light caused by the lens element.

(3) If the cover is made of neutral density light-absorbing material, then the visibility of the baffle from the exterior of the lamp assembly (which may otherwise detract from the appearance of the latter) will be suppressed.

(4) Where the lens element is coloured (as, for example, in a vehicle signalling lamp), any colouration thereof which is visible through the light transmitting portions of the baffle can be suppressed again by making the cover of neutral density light-absorbing material, thereby improving the aesthetic appearance of the lamp assembly.

When provided with lensing as mentioned in paragraph (2) above the cover forms an additional lens element. The additional lens element will normally comprise a multiplicity of lenses which are in no particular registration with the lenses of the first-mentioned lens element. In one particular arrangement, each of the lens elements comprises a multiplicity of mutually parallel, generally cylindrical lenses, with the lenses of the additional lens element extending generally perpendicularly to the lenses of the first-mentioned lens element, so that the additional lens element spreads out the light beam in a different plane to that in which the first-mentioned lens element spreads out the light. In an alternative arrangement, the lenses of the additional lens element are each curved in two mutually generally perpendicular directions.

In a preferred method of producing the baffle, the surface of the first-mentioned lens element to which it is to be applied is formed with recesses or grooves corresponding in position and shape to the desired light-transmitting portions in the finished baffle. A continuous layer of material, desirably at least partly metallic, is adhered to said surface of the lens element and the portions thereof which overlie the recesses or grooves are removed. The baffle is thus composed of the layer of material which covers said surface of the lens element except in the places where the recesses or grooves are formed.

Embodiments of the present invention will now be described, by way of example, with reference to the accompanying drawings, in which.

In each of the embodiments described below, the lamp assembly is designed to be fitted to a vehicle, although it will be appreciated that the principles of this invention can be applied to other forms of lamp assembly.

Figure 1:
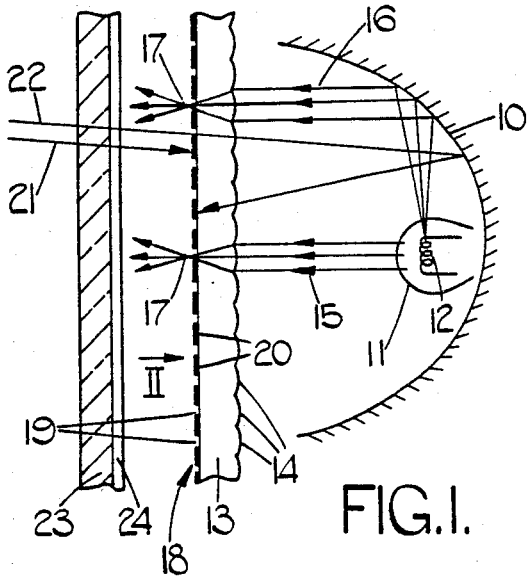
FIG. 1 is a schematic sectional side view of a first embodiment of a lamp assembly according to the present invention.
Figure 2:
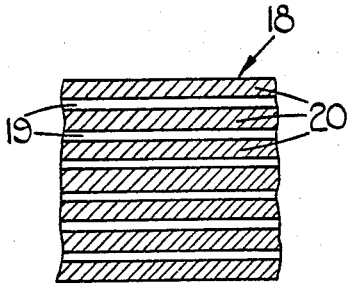
FIG. 2 is a view in the direction of arrow II in FIG. 1 of a baffle which forms part of the lamp assembly.

Referring first to FIGS. 1 and 2, the vehicle lamp assembly shown therein comprises a concave (in this case, paraboloidal) reflector 10 in which a light bulb 11 is received so that a filament 12 thereof is disposed at the focus of the reflector 10. A lens element 13 overlies the reflector 10, and has a multiplicity of individual lenses 14 formed on a surface thereof which faces the bulb 11. In the case where the vehicle lamp assembly is to be used for signalling purposes, the lens element 13 is suitably coloured, e.g. amber for a direction indicator lamp assembly, red for a brake lamp assembly.

In the particular arrangement illustrated, the lenses 14 are cylindrical and extend horizontally in mutually parallel relationship. In this way, light pencils emitted from the bulb filament 12 which reach the lenses 14 directly (as indicated at 15) or after reflection from the reflector 10 (as indicated at 16) are brought to a focus by each lens at a thin horizontal line 17 generally adjacent the opposite surface of the lens element 13.

A baffle 18 is provided on said opposite surface of the lens element 13, and comprises a multiplicity of elongate light-transmitting strips 19 which extend horizontally in mutually parallel relation and which alternate vertically with a multiplicity of similar opaque strips 20. Each of the light-transmitting strips 19 is disposed on the optical axis of a respective one of the lenses 14, and its vertical extent is limited to that necessary to transmit substantially the whole of the light pencil which is focussed by the respective lens.

The lens element 13 thus produces a spread of light in the vertical direction. In order to achieve a suitable spread of light in the horizontal direction also, an additional lens element 23 is provided on the opposite side of the baffle 18 to the lens element 13. In the arrangement shown, the lens element 23 includes a multiplicity of cylindrical lenses 24 (only one of which is visible) which extend vertically in mutually parallel relationship. The lens element 23 can be clear, tinted or made of neutral density light-absorbing material.

In the above-described construction, substantially all of the light emitted by the bulb 11 which reaches the lensing 14 is transmitted through the baffle 18, this effect being enhanced by the fact that those light rays which are reflected by the reflector 10 are rendered parallel thereby and are brought to a predetermined focus by the lenses 14. At the same time, the baffle 18 prevents the passage into the lamp assembly of a large proportion of any externally incident light falling thereon, such as is indicated by the light ray 21, and also prevents re-emission of a large proportion of any externally incident light which manages to reach the interior of the lamp assembly and which is reflected by the reflector 10, as is indicated by the light ray 22. The baffle therefore provides a high contrast between light emanating from the bulb 11 and externally incident light reflected internally of the lamp assembly, so that the latter cannot be mistaken for the former.

Figure 3:
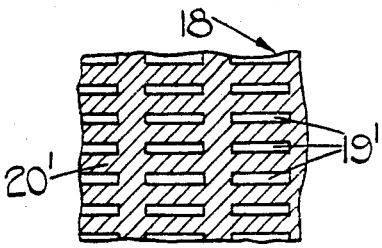
FIGS. 3 and 4 are similar views to FIG. 2 of two modified forms of baffle.
Figure 4:
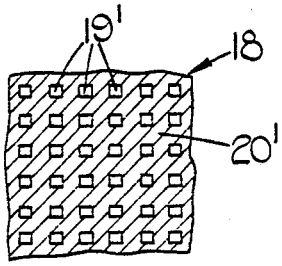

In a modification of the above-described lamp assembly the lenses 14 of the lens element 13 extend vertically rather than horizontally, and the lenses 24 of the lens element 23 extend horizontally rather than vertically. The lenses of the lens elements can, however, have other than cylindrical form. For example, the lenses can each be curved in two mutually perpendicular (e.g. horizontal and vertical) directions so as to take the form of so-called "block lensing." When the lens element 13 is provided with such block lensing, the baffle 18 takes the form of an opaque cross-grid 20', such as shown in FIGS. 3 and 4, the intertices 19' of which are light-transmitting. Each interstice 19' is disposed on the optical axis of a respective one of the lenses 14, and its horizontal and vertical extent are limited to that necessary to transmit substantially the whole of the pencil of light rays focussed by the respective lens 14.

In the case where the horizontal curvature of each lens 14 differs from its vertical curvature, the pencil of light rays is brought to a different focus in the horizontal plane from that in the vertical plane, and the interstices 19' of the baffle 18 are made rectangular to allow for this, as shown in FIG. 3. In the case where the lenses 14 have equal horizontal and vertical curvatures, i.e. where the lenses 14 are each part-spherical, the pencils of light are brought to the same focus in both horizontal and vertical planes, and the interstices 19' of the baffle 18 are therefore made square, as shown in FIG. 4.

Figure 5:
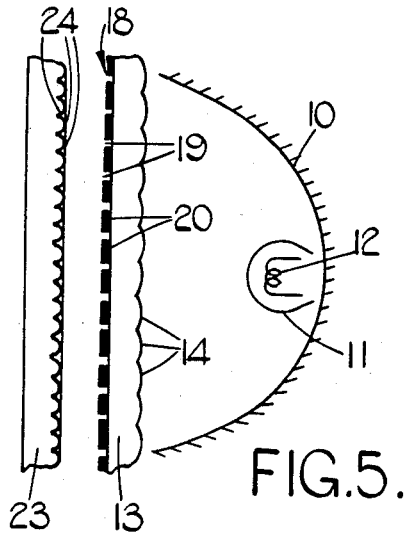
FIG. 5 is a schematic sectional side view of a second embodiment of a lamp assembly according to the present invention.

The lens element 23 can also be provided with block lensing, as illustrated in FIG. 5, with the lens element 13 taking any of the above-described forms. In this case, there need not be any particular registration between the lenses 24 of the lens element 23 and the lenses 14 of the lens element 13.

In a further modification of the lamp assembly, either or each of the lens elements 13 and 23 have mutually parallel cylindrical lenses on each surface thereof, the lenses on one surface thereof extending perpendicularly to the lenses on the other surface.

Figure 6:
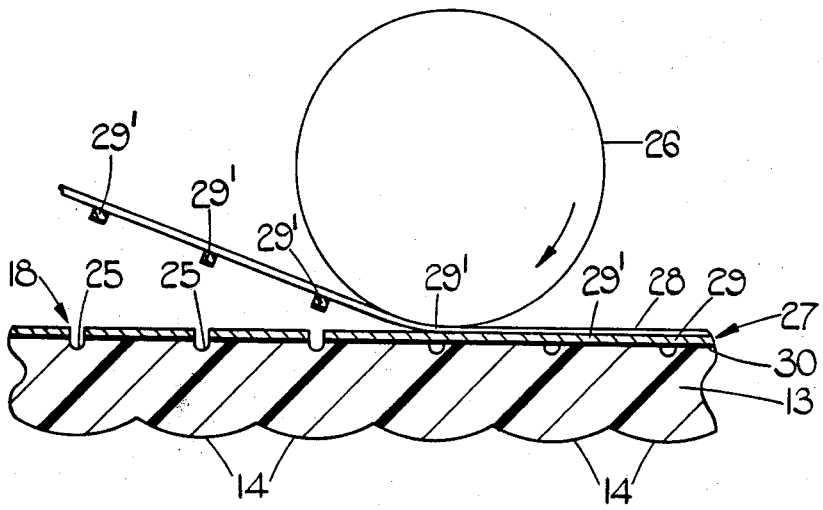
FIG. 6 is a diagram illustrating a preferred method of producing the baffle of the lamp assembly.

In each of the embodiments described above, the opaque parts 20, 20' of the baffle 18 can be made black, bright silver or any other suitable colour. The opaque parts can be provided on the lens element 13 by a photographic process or by securing a suitably shaped screen thereto. Where the opaque parts form a cross-grid, the cross-grid can be composed of two sets of opaque strips, the strips in each set being mutually parallel and the two sets of strips being mutually perpendicular. One set of strips can be placed over the other, or the two sets can be interwoven. However, a preferred method of producing the baffle will now be described with reference to FIG. 6.

Initially, a series of recesses or grooves 25 are formed in the opposite surface of the lens element 13 to that on which the lenses 14 are provided, the positions and shapes of these recesses or grooves corresponding to the desired positions and shapes of the light-transmitting portions in the finished baffle. A roller 26 is then used to roll onto the surface of the lens element 13 a sheet 27 of material composed of a backing layer 28 having a metal layer 29 thereon. A surface of the metal layer 29 remote from the backing layer 28 has a pressure and/or heat activatable adhesive layer 30 thereon, and the sheet 27 is rolled onto the lens element 13 so that the adhesive layer 30 is in contact therewith. The roller 26 is used to apply pressure and/or heat to the sheet 27 to activate the adhesive layer 30, as a result of which the metal layer 29, apart from those portions 29' thereof which are disposed over the recesses or grooves 25, becomes secured to the lens element 13. The backing layer 28 is then peeled away from the lens element, taking the portions 29' of the metal layer with it, as shown in the left-hand part of FIG. 6. As a result, the surface of the lens element 13 remote from the lenses 14 is covered by the metal layer 29 except in those places where the grooves or recesses 25 are provided, thus producing the baffle 18. This technique of applying the metal layer 29 to the lens element 13 is often called "hot-foiling."

It will be manifest that this method of producing the baffle (and indeed any other method which utilizes sheet or plate material for producing the baffle) is practicable only where the surface of the lens element 13 to which it is secured is developable from a flat plane (eg. where it is planar or is curved only in a plane perpendicular to the rotation axis of the roller 26). In styling applications where the external surface of the lamp assembly must be curved in two different directions, such curvature can be provided on the additional lens element 23, leaving the lens element 13 free to be made of suitable shape for such a method of producing the baffle.

In an alternative arrangement (not shown) to those described above, the lens element 23 is replaced by a plain cover having no lensing thereon. In this case, the cover is advantageously tinted or made of a neutral density light-absorbing material.

I claim:

1. A lamp assembly comprising a reflector adapted to receive a light bulb therein, a first lens element overlying said reflector and having a first surface facing said light bulb and a second surface remote from said light bulb, a multiplicity of individual lenses provided on said first surface of said first lens elements and each having a respective optical axis, a baffle which is made of plate or sheet material and is secured to said second surface of said first lens element, said baffle including a multiplicity of light-transmitting portions, each said light transmitting portion being disposed on said optical axis of a respective one of said individual lenses and being limited in its extent to that necessary to transmit substantially the whole of a pencil of light rays which is focussed by the said respective one of said individual lenses, the remainder of said baffle being at least partially light-obstructing, and a cover positioned on the opposite side of said baffle to said first lens element, said cover having a surface which forms an external surface of said lamp assembly.

2. The lamp assembly according to claim 1, wherein said cover is provided with lensing thereon so as to form a second lens element.

3. The lamp assembly according to claim 2, wherein said second lens element includes a multiplicity of individual lenses which are in no particular registration with said lenses of said first lens element.

4. The lamp assembly according to claim 2, wherein said individual lenses of said second lens element are each generally cylindrical and are mutually parallel.

5. The lamp assembly according to claim 4, wherein said individual lenses of said first lens element are each generally cylindrical and are mutually parallel, and said individual lenses of said second lens element extend perpendicularly thereto.

6. The lamp assembly according to claim 2, wherein said individual lenses of said second lens element are each curved in two mutually generally perpendicular directions.

7. The lamp assembly according to claim 1, wherein said cover is tinted.

8. The lamp assembly according to claim 1, wherein said cover is made of neutral density light-absorbing material.

9. The lamp assembly according to claim 8, wherein said first lens element is coloured.

10. The lamp assembly according to claim 1, wherein said surface of the cover is non-developable from a flat plane.

11. The lamp assembly according to claim 1, wherein said second surface of said first lens element defines therein recesses which correspond in position and shape to said light-transmitting portions of said baffle, and said baffle is composed of a layer of material which covers said second surface except in those places where the recesses are defined.

12. The lamp assembly according to claim 11, wherein said baffle comprises a continuous layer of material which is adhered to said second surface of said first lens element and from which portions thereof which overlie the recesses are removed.

13. The lamp assembly according to claim 11 or 12, wherein said layer of material is at least partly metallic.

14. The lamp assembly according to claim 1, wherein said baffle is made of a reflective material.

15. The lamp assembly according to claim 1, in the form of a vehicle signalling lamp assembly.

16. A lamp assembly comprising a reflector adapted to receive a light bulb therein, a first lens element overlying said reflector and including a multiplicity of lenses each of which has a respective optical axis, a baffle which is disposed on a side of said first lens element remote from said light bulb and which includes a multiplicity of light-transmitting portions, each said light-transmitting portion being disposed on said optical axis of a respective one of said individual lenses and being limited in its extent to that necessary to transmit substantially the whole of a pencil of light rays which is focussed by the said respective one of said individual lenses, the remainder of said baffle being at least partially light-obstructing, and a continuous cover positioned on the opposite side of said baffle to said first lens element and having a surface which forms an external surface of said lamp assembly, said cover being provided with lensing thereon so as to form a second lens element.

17. The lamp assembly according to claim 16, wherein said second lens element includes a multiplicity of individual lenses which are in no particular registration with said lenses of said first lens element.

18. The lamp assembly according to claim 17, wherein said individual lenses of said second lens element are each generally cylindrical and are mutually parallel.

19. The lamp assembly according to claim 17, wherein said individual lenses of said second lens element are each curved in two mutually generally perpendicular directions.

20. The lamp assembly according to claim 16, wherein said cover is tinted.

21. The lamp assembly according to claim 16, wherein said cover is made of neutral density light-absorbing material.

22. The lamp assembly according to claim 16, in the form of a vehicle lamp.

* * * * *